United States Patent [19]

Davis

[11] 4,149,831

[45] Apr. 17, 1979

[54] DOUBLE-ACTING DIFFERENTIAL PISTON SUPPLY PUMP

[75] Inventor: Charles W. Davis, Simsbury, Conn.

[73] Assignee: Stanadyne, Inc., Windsor, Conn.

[21] Appl. No.: 859,846

[22] Filed: Dec. 12, 1977

[51] Int. Cl.[2] ..... F04B 3/00; F04B 5/00; F04B 25/02

[52] U.S. Cl. ..... 417/251; 417/259; 417/266; 417/267

[58] Field of Search ..... 417/268, 267, 259, 261, 417/250, 254, 552, 541, 251, 252, 266

[56] References Cited

U.S. PATENT DOCUMENTS

| | | | |
|---|---|---|---|
| 833,457 | 10/1906 | Hammond | 417/259 X |
| 1,936,328 | 11/1933 | Siesler | 417/259 |
| 2,485,208 | 10/1949 | Longenecker | 417/254 |

FOREIGN PATENT DOCUMENTS

| | | | |
|---|---|---|---|
| 227216 | 8/1943 | Switzerland | 417/268 |

*Primary Examiner*—Carlton R. Croyle
*Assistant Examiner*—Richard E. Gluck
*Attorney, Agent, or Firm*—Prutzman, Kalb, Chilton & Alix

[57] ABSTRACT

A supply pump comprising a body having an inlet and an outlet both in fluid communication with an interior region of the body which contains two pistons positioned to reciprocate coaxially and which define three variable volume chambers, one between the two pistons and in fluid communication with the inlet, a second between one piston and the outlet and a third between the other piston and the outlet. The pistons have different working areas, and the piston of larger area carries a check valve which allows fluid flow from the chamber between the pistons to the chamber between the larger piston and the outlet. A regulating spring acts between the body and the smaller piston to urge both pistons against a mechanical drive means including a reciprocable rod carried by a tappet contacting a driven cam. During each forward and reverse stroke of the pistons in response to rotation of the cam, supply fluid is drawn into the pump through the inlet and forced out of the pump through the outlet.

7 Claims, 1 Drawing Figure

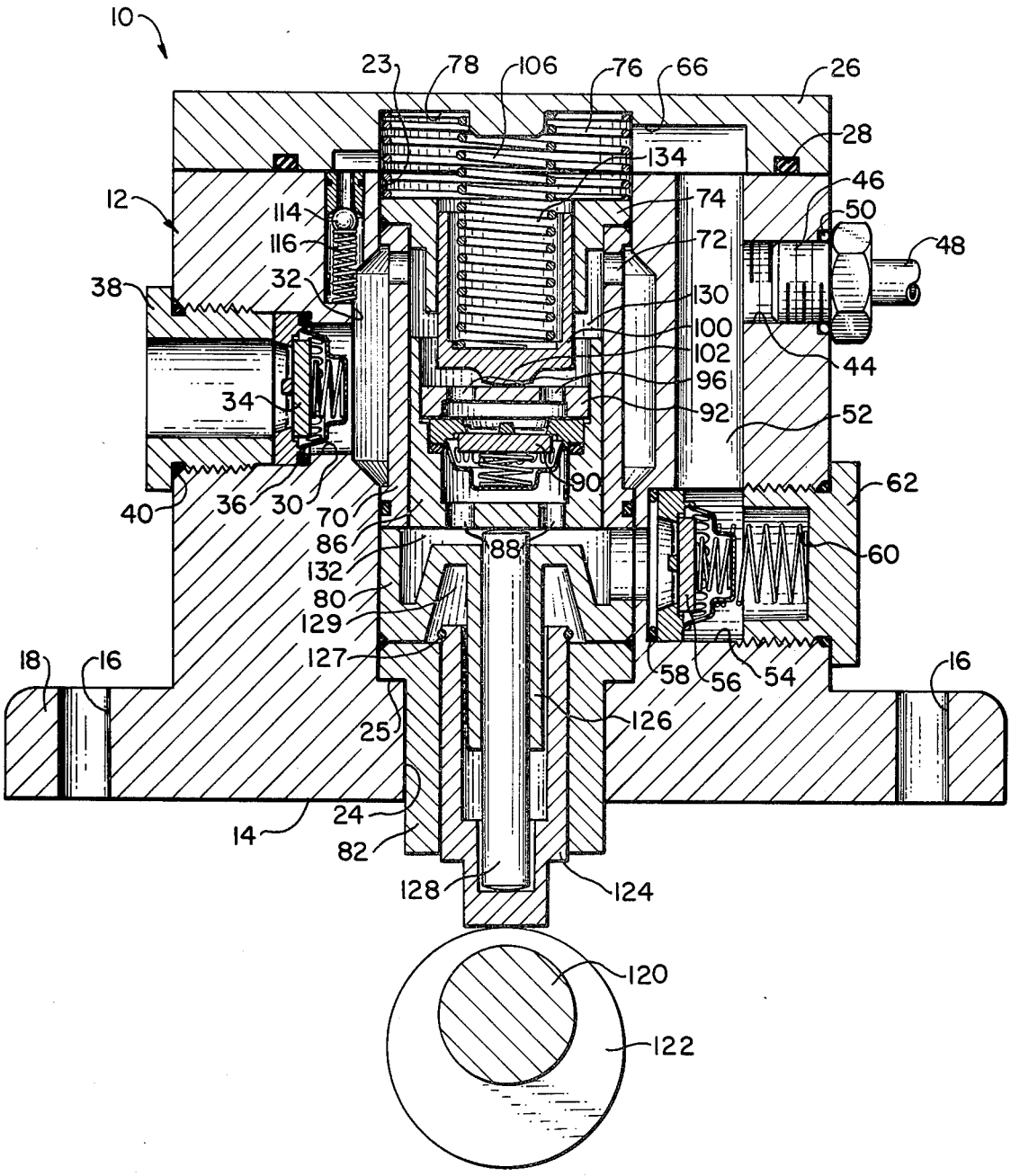
10
23
78
106
76
66
26
28
134
46
50
48
12
114
116
74
72
38
32
130
100
102
96
92
44
52
34
90
62
40
36
30
70
86
88
60
132
80
129
127
18
16
58
56
54
16
25
126
24
14
82
128
124
120
122

DOUBLE-ACTING DIFFERENTIAL PISTON SUPPLY PUMP

This invention relates to the pump art, and more particularly to a new and improved supply pump characterized by increased speed of operation and more uniform supply fluid delivery.

In recent times a need has developed for supply pumps to deliver large quantities of fuel for use by large diesel engines. The speed and quantity requirements of fuel delivery to such engines exceed the capabilities of conventional single-acting pumps. The maximum output of single-acting pumps is limited by the maximum fluid which can be drawn into such pumps which, in turn, is limited by the possibility of cavitation occuring at the pump inlet. Some other important considerations in providing a pump to meet such speed and quantity requirements are regulating the pump operation as a function of output fluid pressure and minimizing loading on the pump drive.

It is, therefore, a primary object of this invention to provide a new and improved fluid supply pump.

It is a further object of this invention to provide such a supply pump which operates at relatively high speed and provides a relatively uniform fluid output or delivery.

It is a further object of this invention to provide such a supply pump of increased capacity which is not subject to inlet cavitation.

It is a further object of this invention to provide such a supply pump which is self-regulating with respect to output fluid pressure.

It is a further object of this invention to provide such a supply pump which operates in a manner reducing loading on the pump drive.

It is a further object of this invention to provide such a supply pump which is relatively simple in construction and efficient and effective in operation.

Other objects will be in part obvious and in part pointed out more in detail hereinafter.

A better understanding of the invention will be obtained from the following detailed description and the accompanying drawing of an illustrative application of the invention.

Referring now to the drawing, a pump 10 illustrative of the present invention is shown as including a body 12 having a base flange 14 adapted to be secured to a supporting surface by fastening elements such as bolts (not shown) which extend through apertures 16 in a peripheral flange 18 extending from body 12 adjacent flange 14. Body 12 has an open interior region or space defined by a first longitudinal bore 23 extending inward from cover 26 which meets a smaller diameter bore 24 at a shoulder 25, the bore 24 extending longitudinally for the remainder of body 12 and terminating at base flange 14. The interior space is closed by a cover 26 fixed to the pump body 12 by suitable fasteners such as screws (not shown). The inner surface of cover 26 is provided with an annular groove which carries a sealing gasket in the form of an O-ring 28 to provide a fluid-tight seal between cover 26 and pump body 12.

Pump body 12 is shown as being provided with a lateral bore 30 extending inwardly through the pump body 12 to define an inlet passage in fluid communication with an enlarged diameter portion of the bore 23 which defines an annular internal passage 32 in body 12. A one-way check valve 34 is located in inlet passage and an O-ring 36 provides a fluid-tight seal between the periphery of valve 34 and the pump body. Valve 34 is held in passage 30 by a bushing 38 threaded into the inlet passage which also facilitates connection of a supply conduit (not shown) to the inlet passage 30. Valve 34 is not essential to the operation of pump 10 but eliminates the possibility of draining the pump when it is not operating. An O-ring 40 provides a fluid-tight seal between the bushing 38 and pump body 12. The pump body 12 is provided with another lateral bore extending inwardly through the pump body 12 to define an outlet passage 44. Outlet passage 44 is threaded to receive a threaded connector 46 on the end of a discharge conduit 48. An O-ring 50 provides a fluid-tight seal between the connector 46 and pump body 12. Passage 44 communicates with a longitudinal bore 52 in the pump body which intersects a laterally extending bore or passage 54 to provide fluid communication therewith. A one-way check valve 56 similar to check valve 34 is located in passage 54 and is sealed thereto by an O-ring 58. A spring 60 seated against a plug 62 serves to hold valve 56 in place in a manner allowing for manufacturing variations.

A sleeve 70 in bore 23 defines the annular passage 32, which is in fluid communication with the interior of sleeve 70 through a plurality of circumferentially spaced apertures 72 in sleeve 70. The end face of sleeve 70 facing toward cover 26 abuts an annular shoulder formed in a collar 74 having a maximum outer diameter substantially equal to the diameter of bore 23. An intermediate portion of collar 74 has an outer diameter substantially equal to the inner diameter of sleeve 70. The remainder of collar 74 has an outer diameter less than the inner diameter of sleeve 70 thereby defining an annular region or chamber between collar 74 and sleeve 70 adjacent apertures 72. A spring 76, one end of which is received in an annular depression 78 of cover 26 biases sleeve 70 against a guide element 80 received within bore 23 and abutting a flanged sleeve 82 bottomed against a shoulder formed by the junction of bores 23 and 24. Spring 76 thus holds collar 74, sleeve 70, guide 80 and sleeve 82 in place in a manner allowing for manufacturing variations.

A first piston 86 is mounted for reciprocation within sleeve 70. Piston 86 is generally cup-shaped having an end wall facing the guide 80, which end wall is provided with a plurality of apertures 88. A one-way check valve 90 similar to check valves 34 and 56 is carried in piston 86. Valve 90 is held in sealed engagement with piston 86 by a plate 92 having apertures 96 also carried in piston 86.

A second piston 100 is mounted for reciprocation in collar 74 coaxially with piston 86. Piston 100 is generally cup-shaped and has a solid end wall provided with a central projection 102 which abuts plate 92 to maintain space between the end wall of piston 86 and plate 92 to prevent the obstruction of apertures 96. A spring 106 seated by cover 26 is received in piston 100 to bias piston 100 downwardly against plate 92.

The pump shown further includes a tappet 124 mounted for reciprocation in sleeve 82 and positioned with one end engageable with eccentric cam 122. Guide 80 is provided with a depending sleeve 126 and an annular recess 129 to permit the reciprocation of tappet 124. A spring retainer 127 is carried in a circumferential groove on the outer surface of tappet 124 and serves to maintain tappet 124 assembled prior to installation.

A rod 128 is reciprocably mounted by sleeve 126 and has one end in engagement with the closed end of tappet 124 and its other end in engagement with the end wall of piston element 86. Thus, as shaft 120 is rotated, tappet 124 and rod 128 are driven upwardly and drive piston 86 and piston 100 upwardly in unison for one-half the rotation of shaft 120. During the remaining half of each rotation of shaft 120, spring 106 urges the pistons 86 and 100 downwardly in unison.

In the construction described above, pistons 86, 100 in cooperation with associated components define three variable volume chambers. A first chamber 130 in continuous fluid communication with inlet passage 30 is provided with sleeve 70 between pistons 86 and 100. A second chamber 132 is provided between piston 86 and guide 80 and is in fluid communication with the outlet passage 44 through passages 54 and 52. The third chamber 134 is provided above piston 100 and is in continuous fluid communication with outlet passage 44 through passages 66 and 52. Preferably, the working area of piston 86 is twice the working area of piston 100 to cause equal quantities of fuel to enter inlet passage 30 and to be discharged from outlet passage 44 during the movement of the pistons 86, 100 in each direction.

In operation, as pistons 86 and 100 are driven upward by eccentric cam 122, fuel will be pumped through outlet passage 44 from chamber 134 by piston 100. Simultaneously, the expansion of chamber 132 due to the movement of piston 86 (check valve 56 being closed) will create a suction therein so that fuel from inlet 30 will enter chamber 132 through check valve 90. A part of this fuel will be supplied by the reduced volume of chamber 130 during upward movement of piston 86, and the other part will be drawn into the pump through inlet passage 30. Where the area of piston 86 is twice that of the area of piston 100, fifty percent of the fuel entering the chamber 132 will enter from inlet 30. Downward movement of the pistons 86, 100 causes the fuel in chamber 132 to be expelled therefrom with fifty percent leaving the pump through outlet passage 44 and the other fifty percent passing into chamber 134 due to the increasing volume thereof. Also during the downward stroke, an amount of fuel equal to that discharged from the pump will be drawn through inlet passage 30 to fill chamber 130.

Thus, where the area of piston 86 is twice the area of piston 100, an equal amount of fluid is drawn from the tank or supply into pump 10 through inlet passage 30 during each upward and downward stroke of the pistons as is expelled or discharged from the pump through outlet passage 44. In other words, the supply pump of the present invention is double-acting with respect to both discharge and suction flow. As a result, suction and discharge velocities are one-half the velocities encountered with a single-acting pump, and the pump of the present invention operates with twice the number of suction and pumping strokes as a single-acting pump. Furthermore, pump 10 has increased capacity and higher speed of operation without inlet cavitation. By having approximately equal inflows of fluid to pump 10 during both pumping strokes, the pump capacity is doubled before cavitation can take place. Having outflow from pump 10 during pumping strokes in both directions reduces the variations in output fluid pressure and volume during each pumping stroke and reduces loading on the drive cam 122.

During the downward stroke of the pistons 86, 100 the pressure in chamber 134 and in chamber 132 is equal to the discharge pressure level. The force causing downward motion of pistons 86, 100 therefore is equal to the force of spring 106 plus the hydraulic force due to the discharge pressure on piston 100 minus the hydraulic force due to discharge pressure on piston 86. Where, as is preferred, the area of piston 86 is twice that of piston 100, the force causing downward motion of the pistons equals the force of spring 106 minus hydraulic force due to discharge pressure on one-half the area of piston 86. When such hydraulic force equals the force of spring 106, downward motion of the piston ceases so that spring 106 serves the additional function of regulating output pressure. Pump 10 therefore has substantially self-regulated discharge pressure according to the force and rate of spring 106.

Although pumping motion of pistons 86, 100 ceases when some predetermined pressure level is reached, rod 128 will continue to be forced in a downward direction by discharge pressure and in an upward direction by rotation of cam 122 regardless of the discharge pressure level, thus functioning like a single-acting pump. Accordingly, the cross-sectional area of rod 128 is made as small as possible to minimize this continued pumping effect. In the event that this small amount of continued pumping cannot be accommodated by the level of flow through discharge passage 44, a spring biased relief valve 114 may be provided to dump fuel from the discharge or outlet passage of pump 10 to the inlet when sufficient pressure build-up occurs to overcome the force of spring 116. The valved relief passage also is of use in the event that limitations of spring 106 cause the pressure rise from full stroke to no stroke to be greater than desired.

As will be apparent to persons skilled in the art, various modifications, adaptations and variations of the foregoing specific disclosure can be made without departing from the teachings of the present invention.

I claim:

1. A supply pump comprising a pump body having means providing a stepped pumping chamber therein, piston means mounted for reciprocation in said pumping chamber and having a pair of working areas of different sizes at the ends thereof respectively mating the stepped portions of the pumping chambers, drive means operatively connected with said piston means for actuating the same in one direction corresponding to a first pumping stroke thereof, spring means operatively connected with said piston means for actuating the same in the opposite direction corresponding to a second pumping stroke thereof, said piston means and said stepped pumping chamber defining a first variable volume chamber, means cooperating with said piston means forming a pair of variable volume pumping chambers at the ends of said piston means, an inlet continuously connected to said first variable volume chamber, passage means interconnecting said pair of variable volume pumping chambers and an outlet connected to said last mentioned passage means and means forming a passage containing a one-way valve interconnecting said first variable volume chamber and the one of said pair of variable volume pumping chambers at the end of the piston means with the larger working area to enable fluid flow from said first variable volume chamber to said one of said pair of variable volume pumping chambers.

2. The supply pump of claim 1 wherein the layer of said pair of working areas is about twice the size of the other.

3. The supply pump of claim 1 wherein one of said piston means comprises a pair of coaxial pistons operatively connected for actuation in unison, and one of said pistons has said passage containing a one-way valve enabling fluid flow from the first variable volume chamber through the one of said pistons to the variable volume chamber at the end thereof.

4. The supply pump of claim 3 wherein a one-way valve is provided between the variable volume chamber at the end of the one of said pistons and said interconnecting passage means.

5. The supply pump of claim 1 wherein said drive means includes a reciprocating drive pin of small diameter operatively connected with the end of the piston means having the larger working area.

6. The pump of claim 5 including a pressure relief valve disposed between said interconnecting passage and said inlet.

7. The pump of claim 1 wherein a one-way valve is provided in the inlet of the pump.

* * * * *

UNITED STATES PATENT AND TRADEMARK OFFICE

CERTIFICATE OF CORRECTION

PATENT NO. : 4,149,831

DATED : April 17, 1979

INVENTOR(S) : Charles W. Davis

It is certified that error appears in the above-identified patent and that said Letters Patent are hereby corrected as shown below:

Column 4, line 66, "layer" should be changed to --larger--.

Signed and Sealed this

*Eighteenth* Day of *September 1979*

[SEAL]

*Attest:*

*Attesting Officer*

LUTRELLE F. PARKER

*Acting Commissioner of Patents and Trademarks*